US011433663B2

(12) United States Patent
Cohen et al.

(10) Patent No.: US 11,433,663 B2
(45) Date of Patent: Sep. 6, 2022

(54) CLEANING ELEMENTS FOR PRINT APPARATUS

(71) Applicant: HP Indigo B.V., Amstelveen (NL)

(72) Inventors: Lavi Cohen, Ness Ziona (IL); Minedys Macias Guzman, San Diego, CA (US); Michael Vinokur, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 46 days.

(21) Appl. No.: 16/605,095

(22) PCT Filed: Sep. 14, 2017

(86) PCT No.: PCT/US2017/051541
§ 371 (c)(1),
(2) Date: Oct. 14, 2019

(87) PCT Pub. No.: WO2019/055015
PCT Pub. Date: Mar. 21, 2019

(65) Prior Publication Data
US 2021/0129522 A1 May 6, 2021

(51) Int. Cl.
*B41F 35/02* (2006.01)
*B41F 35/00* (2006.01)
*B41F 35/04* (2006.01)

(52) U.S. Cl.
CPC ..... *B41F 35/02* (2013.01); *B41F 35/006* (2013.01); *B41F 35/04* (2013.01)

(58) Field of Classification Search
CPC ..... B41F 35/02
USPC ..... 101/425
See application file for complete search history.

(56) References Cited

U.S. PATENT DOCUMENTS 5,138,945 A * 8/1992 Lee ..... B41F 35/02 101/423
5,255,606 A * 10/1993 Iijima ..... B65H 20/02 101/425
5,870,954 A 2/1999 Lovenstein et al.
5,927,205 A 7/1999 Jentzsch et al.
5,943,956 A * 8/1999 Marquez ..... B41F 35/06 101/425
6,432,211 B1 8/2002 Schmitt et al.
(Continued)

FOREIGN PATENT DOCUMENTS

CN 1189413 8/1998
CN 101075109 11/2007
(Continued)

OTHER PUBLICATIONS

Park, Chang-Hyun, et al. "Design optimization of a laser printer cleaning blade for minimizing permanent set." Structural and Multidisciplinary Optimization 49, No. 1 (2014).

*Primary Examiner* — Joshua D Zimmerman
(74) *Attorney, Agent, or Firm* — Brooks Cameron & Huebsch PLLC

(57) ABSTRACT

In an example, a method includes rotating a print apparatus component to be cleaned about a first rotational axis. A cleaning element having a cleaning surface in contact with the print apparatus component may be driven such that the cleaning surface has a component of motion which is parallel to the first rotational axis in a contact region. A relative velocity of the cleaning element and the print apparatus component may be varied during a cleaning operation.

8 Claims, 5 Drawing Sheets

(56) References Cited

U.S. PATENT DOCUMENTS

| | | | | |
|---|---|---|---|---|
| 6,684,784 | B2 | 2/2004 | Kolbe et al. | |
| 7,279,050 | B2 | 10/2007 | Van Epps et al. | |
| 8,750,749 | B2 | 6/2014 | Suzuki et al. | |
| 2006/0266242 | A1 | 11/2006 | Bartesaghi et al. | |
| 2011/0277652 | A1* | 11/2011 | Cyr | G03G 15/6573 101/425 |
| 2015/0068558 | A1 | 3/2015 | Poissant et al. | |
| 2015/0090142 | A1* | 4/2015 | Roberts | B41F 35/02 101/425 |

FOREIGN PATENT DOCUMENTS

| | | | |
|---|---|---|---|
| CN | 101145023 | | 3/2008 |
| CN | 103599908 | A | 2/2014 |
| CN | 105739266 | | 7/2016 |
| CN | 205816365 | U | 12/2016 |
| CN | 206296217 | U | 7/2017 |
| EP | 0977667 | B1 | 2/2000 |
| JP | 0740632 | | 2/1995 |

* cited by examiner

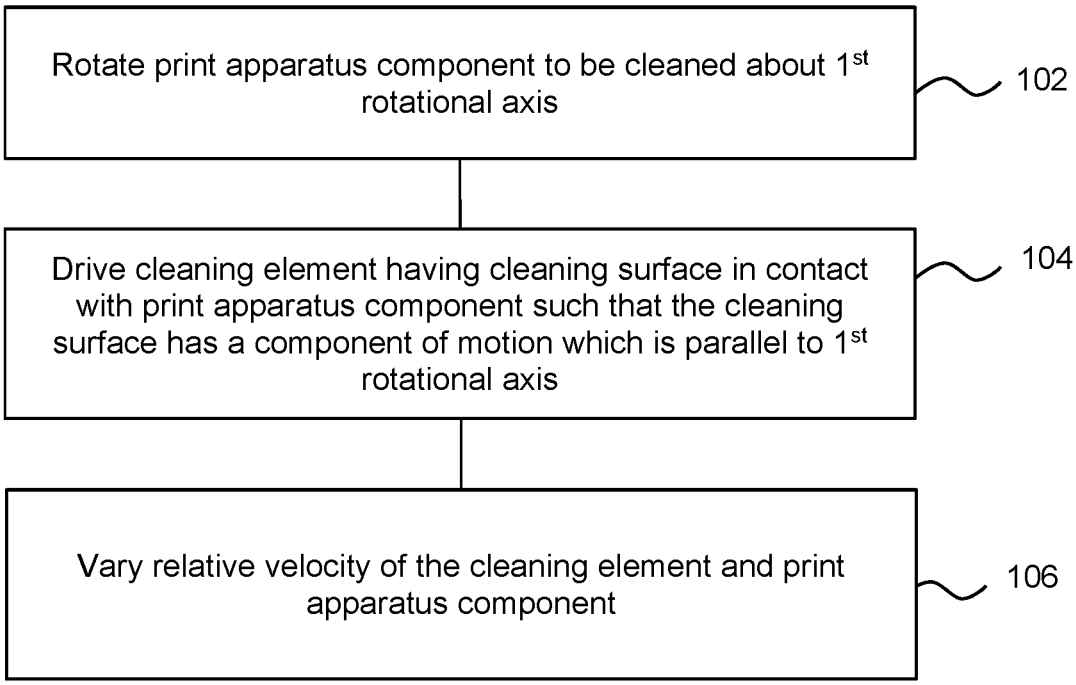
Fig. 1
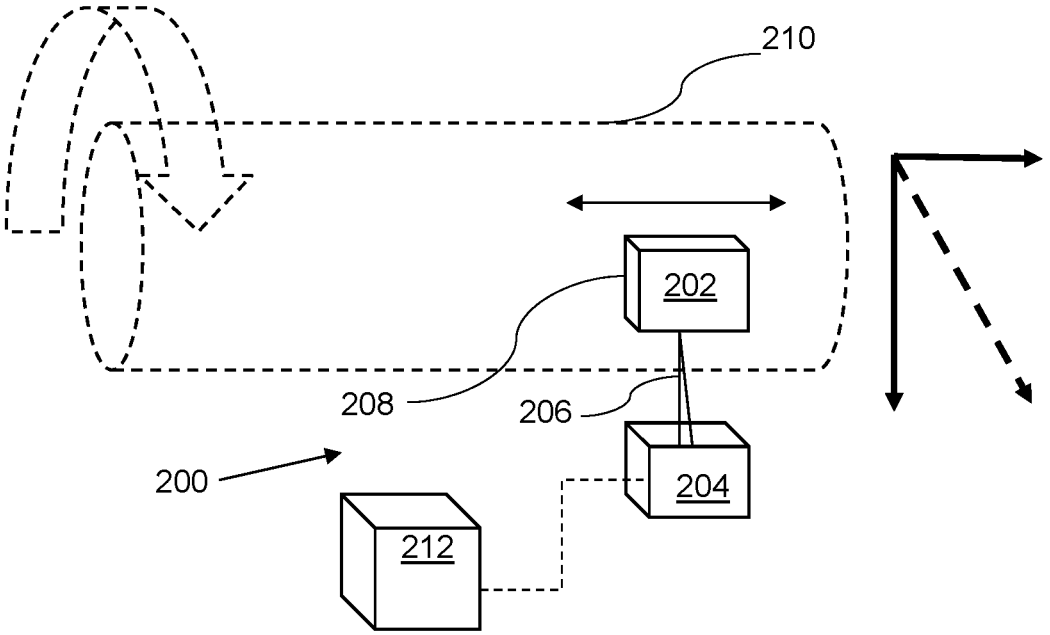
Fig. 2A
Fig. 2B

CLEANING ELEMENTS FOR PRINT APPARATUS

BACKGROUND

In printing, print agents such as inks, toners, coatings and the like may be applied to a substrate. Substrates may in principle comprise any material, for example comprising paper, card, plastics, fabrics or the like.

In such apparatus, surfaces may receive print agents and may periodically be cleaned so as to remove print agent residue and other contaminants so as to maintain image quality.

BRIEF DESCRIPTION OF DRAWINGS

Non-limiting examples will now be described with reference to the accompanying drawings, in which:

FIG. 1 shows an example of a method of cleaning a print apparatus component;

FIG. 2A shows an example of a print apparatus component cleaning apparatus;

FIG. 2B shows a vector diagram illustrating examples of components of motion of the components of FIG. 2A in use upon the surface of the print apparatus component to be cleaned;

DETAILED DESCRIPTION

Figure 3A:
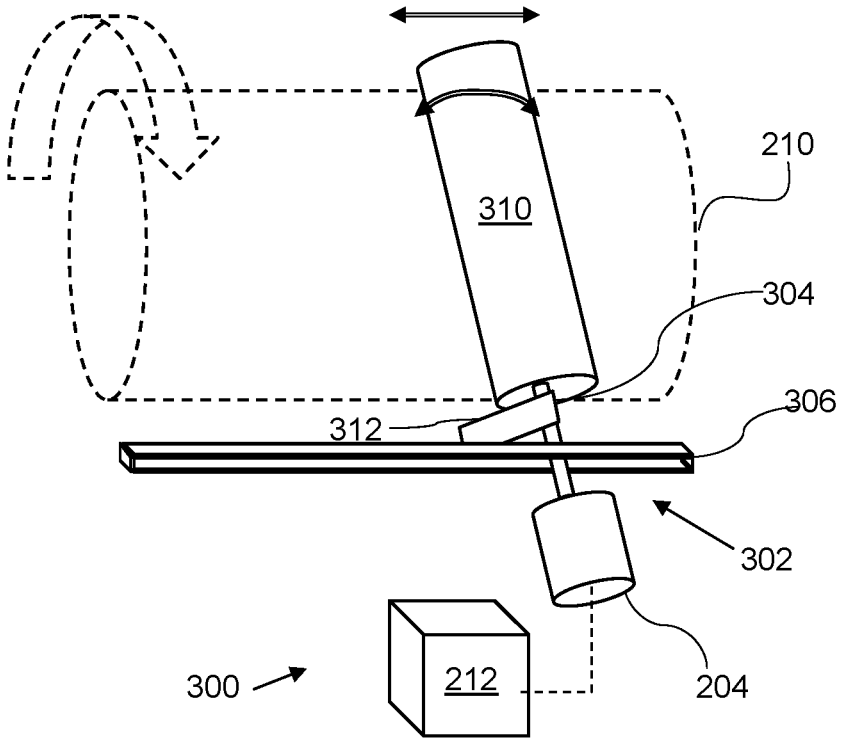
FIG. 3A shows another example of a print apparatus component cleaning apparatus.

Print apparatus components, for example rotating drums, belts and other surfaces, can become dirty or contaminated. In particular, such surfaces can acquire deposits of print agent, machine oil, and/or other by-products of the printing process (e.g. ink residuals with contaminants that exposed to plasma at a charged component of the apparatus create a chemical build-up which is particularly difficult to clean). For example, rollers, belts or drums may be used to transfer print agent through the apparatus before depositing the print agent onto a substrate. When the transfer of agent in producing one image is incomplete, this can result in print quality issues and subsequent images, which may receive an intended print agent marks.

Therefore, such surfaces may be cleaned. For example, sponge cylinders (i.e., cylinders having a sponge outer coating) may be provided which, when brought into contact with a surface of the print apparatus, rotate to remove any such contamination. However, it may be the case that, for example when a defect appears in the sponge surface, there are changes in the texture or the resilience of regions of the sponge over time, or there are hard-to-clean deposits, cleaning is inefficient and/or non-uniform. In addition, if a particle is trapped on the sponge, this may it may create a streak pattern on the surface to be cleaned.

FIG. 1 is an example of a method of cleaning a print apparatus component.

Block 102 comprises rotating the print apparatus component to be cleaned about a first rotational axis. For example, the print apparatus component may comprise a drum, cylinder or roller which rotates about an axle defining the rotational axis, or a belt which rotates about a plurality of axles (in which case, the axles may be parallel, and/or the first rotational axis may be defined by one of the axles).

Block 104 comprises driving a cleaning element having a cleaning surface in contact with the print apparatus component such that the cleaning surface has a component of motion which is parallel to the first rotational axis in a contact region. In other words, the cleaning surface is driven to have relative velocity component along the rotational axis of the print apparatus component to be cleaned. This component may for example be provided by rotation of the cleaning element, wherein the axis of the rotation of the cleaning element is non-parallel to the first rotational axis, and/or by driving the cleaning surface along the length of the component to be cleaned.

Block 106 comprises varying a relative velocity of the cleaning element and the print apparatus component to be cleaned. This may for example comprise varying a velocity of rotation of a cleaning surface, a velocity of translation of a cleaning surface over the print apparatus component to be cleaned, and/or varying the velocity of rotation of the print apparatus component.

By driving a cleaning surface along the length of the first rotation axis of the print apparatus component to be cleaned (for example, while the print apparatus component is being rotated or circulated about the first rotational axis), a diagonal 'wiping line' may be seen (noting that, even if the cleaning surface moves strictly parallel to the axis of rotation of the rotating print apparatus component, the component's rotation means that there is both a tangential and an axial component to their relative velocity, and thus a diagonal wiping line). This can increase the area of cleaning surface which is in contact with a particular pixel on the drum, making cleaning more efficient. Moreover, by changing the relative velocity, the direction of the wiping line may be changed during a cleaning operation, resulting in more uniform cleaning.

For example, cleaning may be more uniform as, by carrying out this method, any defect in the cleaning surface will be displaced relative to the surface it is cleaning throughout the cleaning operation. Therefore, a portion of the surface contacted by a defective portion may be subsequently cleaned by a non-defective portion. To consider, for the sake of comparison, two rotating rollers having parallel rotational axes, one of which operates as a cleaning roller, (i.e. there is no component of motion parallel to the rotational axes: all motion is orthogonal to the rotational axes) a defect in the cleaning roller may cause a streak or smeared vertical line in the processing direction on printed outputs (lines and streaks are particularly susceptible to detection by the human eye). In addition, changing the angle may increase the effectiveness of cleaning a residue by altering the direction of force applied to a residue. It may be noted that failure to consistently and correctly clean print apparatus components can reduce their lifespan.

FIG. 2A shows an example of a print apparatus component cleaning apparatus 200 which may in some examples carry out the method of FIG. 1. The print apparatus component cleaning apparatus 200 in this example comprises a cleaning element 202, a motor 204 and a mounting element 206. In use of the print apparatus component cleaning apparatus 200, the motor 204 drives the cleaning element 202 such that the cleaning surface 208 such has a component of motion which is orthogonal to the motion of the surface to a print apparatus component to be cleaned, which in this example is a drum 210. In this example, the cleaning element 202 is repositioned along the length of the drum 210 by the motor 204.

The drum 210 is shown in dotted lines, to indicate its position relative to the print apparatus component cleaning apparatus 200, and comprises a surface to be cleaned. The dotted arrow is indicative of the rotation thereof. However, the drum 210 does not constitute a part of the print apparatus component cleaning apparatus 200 in this example.

The apparatus 200 further comprises a controller 212 which, in use of the apparatus 200, varies a relative velocity between the cleaning surface and the surface of print apparatus component. In this example, this may comprise controlling and varying the speed of translation of the cleaning element 202 and/or the speed of rotation of the drum 210.

In this example, the cleaning surface 208 is shown as a planar rectangular element, but which could be any shape, and may for example curve so as to follow the contours of the drum 210.

FIG. 2B shows a vector diagram, in which the horizontal vector is indicative of the speed with which the cleaning element 202 is driven along the length of the drum 210 (which provide a component of motion parallel to the axis of rotation of the drum 210, and orthogonal to the motion of the surface of the drum 210), which at the instance considered is left to right. The vertical vector is indicative of a component of motion supplied by the rotation of the drum 210. In this example, it is assumed that the drum 210 rotates faster than the cleaning element 202 is translated along the length of the drum 210, and therefore the vertical arrow is the longer arrow. The diagonal dotted line is indicative of the resulting relative motion, which provides an effective a diagonal wiping line between a point on the cleaning surface 208 and the surface of the drum 210.

By changing the speed of translation of the cleaning element 202 and/or the speed of rotation of the drum 210, the direction of this wiping line may be changed.

FIG. 3A shows another example of a print apparatus component cleaning apparatus 300, in which elements in common with the example of FIG. 2 are labelled with like numbers. In this example, the cleaning surface comprises an endless surface (e.g. an endless belt or loop) which is rotated about a second axis of rotation which is nonparallel to, or offset from, the axis of rotation of the drum 210. For example, the first and second axes may be offset by at least 20°, 30°, 45°, 80° or greater.

In this example, the cleaning element comprises a cleaning roller 302 which is mounted such that its axle 304 (which in this example defines the second axis of rotation) is nonparallel to the axle of the drum 210 to be cleaned. In this example, the axles are substantially orthogonal, that this may not be the case in examples. Even when the axles are non-orthogonal, there may be a component of motion of the surface parallel to the length of the drum 210. However, it may be noted that, if the axles are substantially orthogonal as shown in FIG. 3A, the velocity component parallel to the length of the drum 210 is maximised. The axle 304 is mounted on a mounting rail 306, which is in this example comprises a longitudinal slot running parallel to the axle of the drum 210 to be cleaned. In this example, the cleaning roller 302 comprises an endless surface 310 about the circumference of the cleaning roller 302.

In this example, the motor 204, in use of the print apparatus component cleaning apparatus 300, drives the cleaning roller 302 along the length of the rail 306. In other words, the motor 204, in conjunction with the rail 306, act to provide a cleaning element translation mechanism. In addition, the cleaning roller 302 rotates about its axle 304. The print apparatus component cleaning apparatus 300 further comprises a controller 212, as described in relation to FIG. 2.

The cleaning roller 302 comprises a sponge cleaning surface 310. In some examples, this may comprise an alumina coated sponge, an abrasive pad or any other cleaning substrate, and which may in some examples be wetted with a cleaning substance. In this example, the axle 304 is acted upon by a biasing element 312, which in this example comprises a leaf spring. This arrangement provides a predetermined pressure between the cleaning roller 302 and a drum 210 to be cleaned. In other examples, the biasing force could be provided by any element that can cause or control a biasing force the pressure between the roller 302 and the drum 210, such as a spring or a sponge deflection arrangement. In some examples, the may be adjustable. In some examples, the biasing force may be an adjustable biasing force (for example motorized) and controlled in real-time.

Figure 3B:
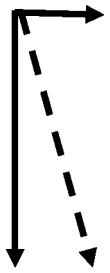
FIGS. 3B and 3C show vector diagrams illustrating examples of components of motion of the apparatus shown in FIG. 3A in use.
Figure 3C:
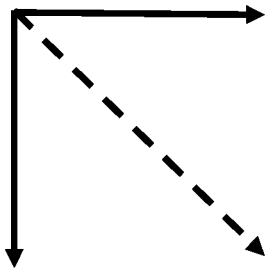

FIGS. 3B and 3C are vector diagrams demonstrating how a change in the cleaning element speed (axial component) affects the relative speed of the components and can alter a direction of a resulting wiping line. The velocity of rotation of the cleaning surface 310 and the velocity of translation of the cleaning element 302 combine to provide a component of motion which is parallel to the axis of rotation of the drum 210, illustrated as a horizontal vector in FIGS. 3B and 3C. In practice, it is likely that the speed of rotation will contribute more to the magnitude of this component of motion than the speed of translation, although this need not be the case. The component of motion due to the drum's rotation is shown as a vertical vector.

In FIGS. 3B and 3C, it is assuming that the drum 210 rotates at a constant speed. Therefore, a change in the resulting dotted diagonal vector indicative of a wiping line for each point on the cleaning surface 310 depends on the combined velocities of rotation and translation of the cleaning surface 310. FIG. 3B shows a relatively slow combined velocity, whereas FIG. 3C shows a relatively fast combined velocity. As can be seen, the orientation of the wiping line of the cleaning surface 310 on the drum 210 to be cleaned changes.

In some examples, setting the orientation of the wiping line may have an effect on the contact area between the sponge cleaning surface 310 and the drum 210 to be cleaned. Therefore, the cleaning roller 302 may be driven with a predetermined velocity of revolution and/or translation in order to provide an intended contact area it increases the sponge area that is in contact with a drum, which may in turn result in a more efficient cleaning action.

At least one of the rotation of the cleaning surface 310, translation of the cleaning surface 310 and the rotational velocity of the drum 210, may be varied under the control of the controller 212, so as to change the orientation of the wiping line. For example, by increasing a speed of rotation, a wiping line may be changed from the orientation shown in FIG. 3B to that shown in FIG. 3C. This in turn may mean that an area of the drum 210 which may have been contacted by a defective area of the sponge will now be contacted by a different area of the sponge. Moreover, changing the wiping angle in itself can improve cleaning, in particular for stubborn residues.

For example, the rotational velocity of the cleaning roller 302 may vary according to a function, which may be a predetermined function, so as to create a wiping line which changes in direction and/or speed throughout the cleaning operation. In some examples, the velocity may be varied substantially throughout the cleaning operation service to provide a continuously changing orientation of the wiping line. This can result in efficient cleaning of an entire drum 210.

Figure 4:
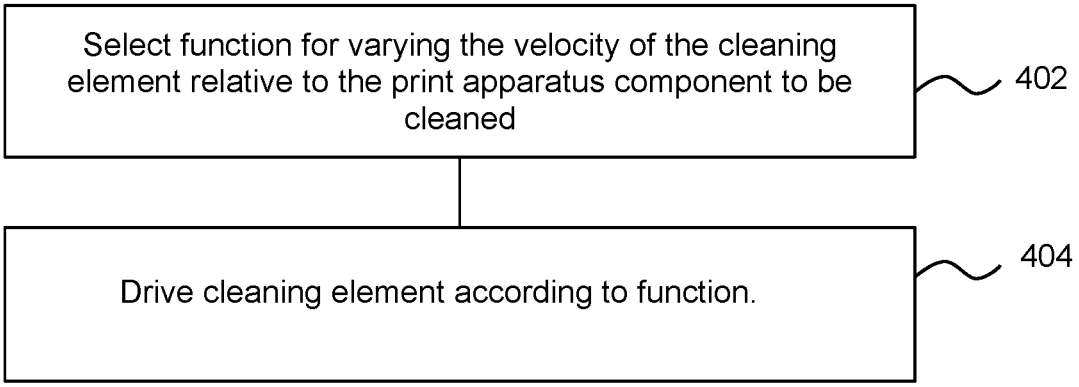
FIG. 4 shows an example of a method of cleaning a print apparatus component.

FIG. 4 is an example of a method of cleaning a print apparatus component, which may be carried out using the apparatus of FIG. 3.

Block 402 comprises selecting a function for varying the velocity of the cleaning element relative to the print apparatus component to be cleaned. For example, the function may comprise a sawtooth function, a sinusoid function, or any other function which results in a variation in the speed or direction of motion. The variation may be a variation in the axial component of speed or in the rotational component of the speed, or both, and may in some examples comprise a change in direction.

For example, a cleaning roller with a diameter or around 30 mm may rotate with a speed which varies between −4000 to 4000 revolutions per minute, and which has a speed across the drum 210 of around 2-4 meters per second (which may also be variable in some examples). Of course, this is simply by way of example and speeds may vary considerably for a given apparatus set-up.

In some examples, a velocity variation may be applied to the print apparatus component to be cleaned (which in effect changes the length of the vertical vector in FIGS. 2B, 3B and 3C).

Block 404 comprises driving the cleaning element according to the function.

As described above, this may result in change in wiping line, which may in turn reduce streaks and the like on a printed image. In some examples, the position of any defect in the cleaning surface relative the surface to be cleaned may be altered during the cleaning process, which means that the chances that a portion of the surface which is cleaned by a portion of cleaning surface having a defect will also be cleaned by a portion of cleaning surface absent a defect, and/or that any areas which are not effectively cleaned will be isolated, rather than comprising eye-catching streaks. This may also mean that more defects in a cleaning surface may be tolerated before an undue impact on print quality is seen, increasing the operational life of a cleaning element.

Where a dirt particle becomes trapped, providing an axial speed component resulting in a diagonal wiping line may assist in urging the dirt particle out of any image forming or processing region (which may be contrasted with parallel sponge configuration that will tend to move the particle's position on the drum surface, but leaves it within the image forming/processing region).

Figure 5:
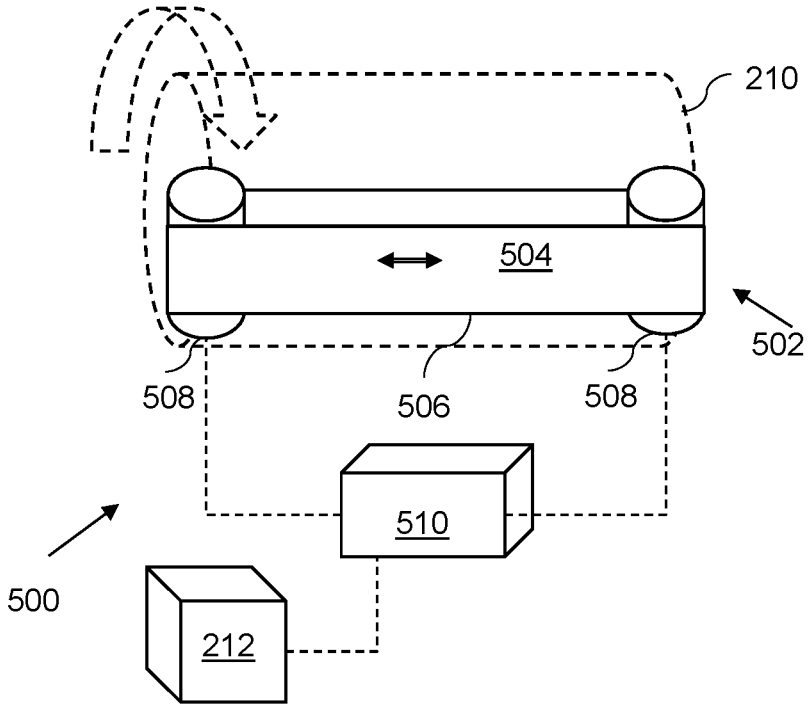
FIGS. 5 to 7 show examples of a print apparatus component cleaning apparatus.

FIG. 5 shows another example of a print apparatus component cleaning apparatus 500 in which the cleaning element 502 comprises a cleaning surface 504 on an endless belt 506 mounted on, and driven around, a pair of rollers 508 by a motor 510. Elements of the print apparatus component cleaning apparatus 500 in common with the examples of FIG. 2 and FIG. 3 are labelled with like numbers. In some examples, the velocity of the belt 506 over the rollers 508 and/or or the velocity of translation may be altered during cleaning operations, as described above.

Figure 6:
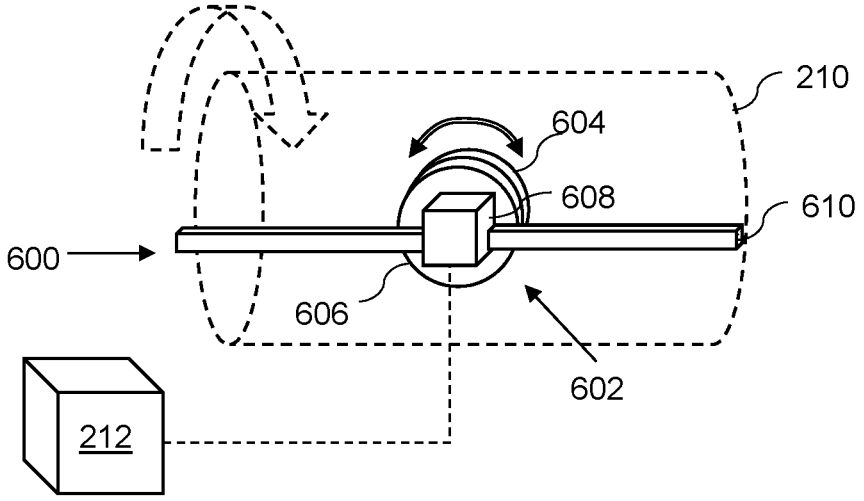

FIG. 6 shows another example of a print apparatus component cleaning apparatus 600 in which the cleaning element 602 is a rotating cleaning element, in this example comprising a cleaning surface 604 on rotating disc 606 driven by a motor 608 (i.e. in this example, the cleaning element 602 comprises a rotating surface). Elements of the print apparatus component cleaning apparatus 600 in common with the examples of FIGS. 2, 3 and 5 are labelled with like numbers. A mounting element 610 (in this example in the form of a rail) is provided. In this example, the mounting element 610 allows the position of the cleaning element 602 along the length of the print apparatus component to be cleaned, but this need not be the case in all examples.

The cleaning surface 604 and/or the rotating disc 606 may deform to conform to the shape of the print apparatus to be cleaned.

In some examples, the velocity of rotation of the disc 606 and/or translation may be altered during cleaning operations, as described above. It may be noted that the velocity of a point on the cleaning surface will in this example change with radial distance from the centre.

Figure 7:
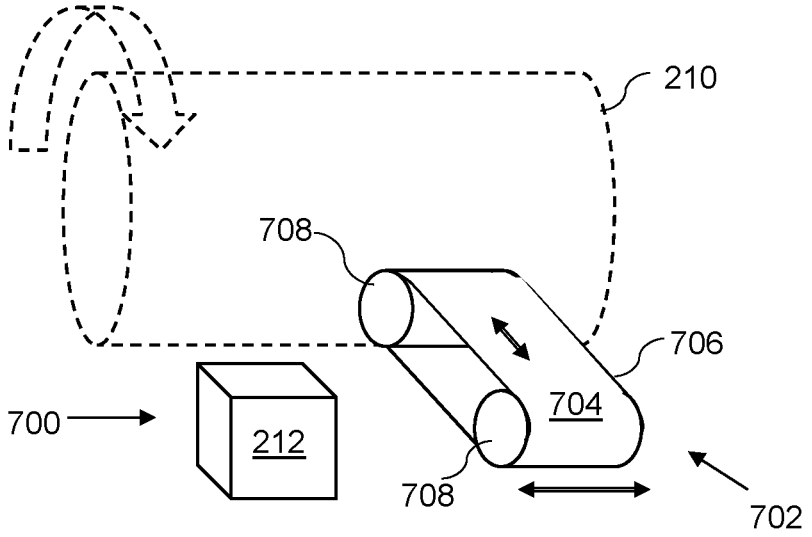

FIG. 7 shows an alternative example of a print apparatus component cleaning apparatus 700 in which the cleaning element 702 comprises a cleaning surface 704 on an endless belt 706 driven around a pair of rollers 708 in use of the apparatus. The cleaning element 702 may, in use of the apparatus 700, be translated along the length of a drum 210 to be cleaned, as indicated with the arrow. Elements of the print apparatus component cleaning apparatus 700 in common with the examples of FIGS. 2, 3, 5 and 6 are labelled with like numbers. In some examples, the velocity of the belt 706 over the rollers 708 and/or or the velocity of translation may be altered during cleaning operations, as described above. It may be noted that the cleaning element 702 in this example could be replaced by a roller having an axle which is substantially parallel to the axis of rotation of the drum 210.

Figure 8:
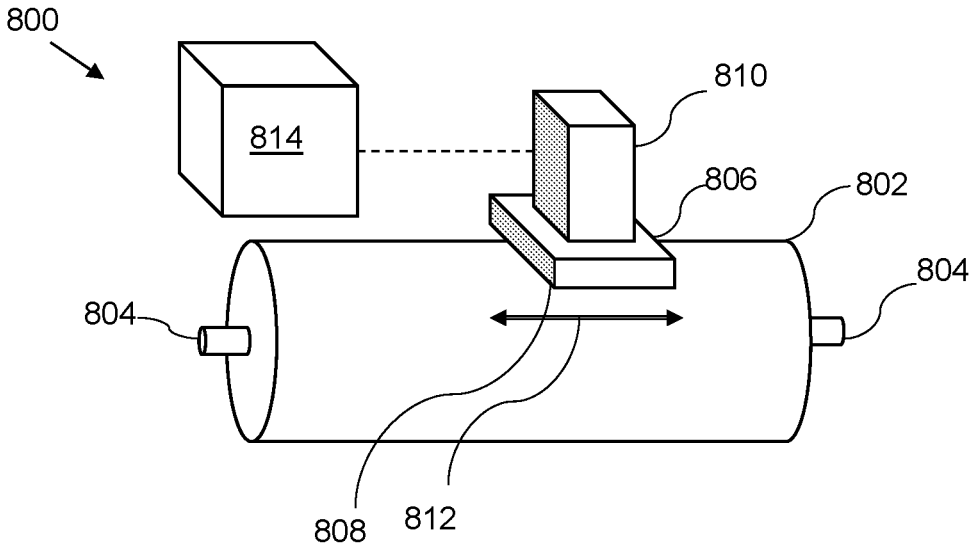
FIG. 8 shows an example of a print apparatus.

FIG. 8 shows an example of a print apparatus 800. The print apparatus 800 comprises a drum 802 mounted on a drum axle 804 and a cleaning element 806 having a cleaning surface 808 in contact with the surface of the drum 802. A motor 810 is provided to, in use of the print apparatus 800, drive cleaning surface so as to have a component of motion (arrow 812) parallel to the drum axle 804. The print apparatus 800 further comprises a controller 814 to control a speed and/or direction of the motor 810.

The drum 802 may for example carry a photoconductive surface of an electrophotographic print apparatus. In another example, the drum 802 may comprise a substrate transport roller, an intermediate transfer member to transfer print agent from a photoconductive surface to a substrate (also called a 'blanket drum' in some examples), a developer roller to provide a layer of print agent to a photoconductive surface, or the like.

The print apparatus 800 may comprise additional components not shown here, for example print agent supply units, charging units, optical elements (for example, lasers to discharge a photoconductive surface and the associated apparatus), substrate handling apparatus and the like.

Figure 9:
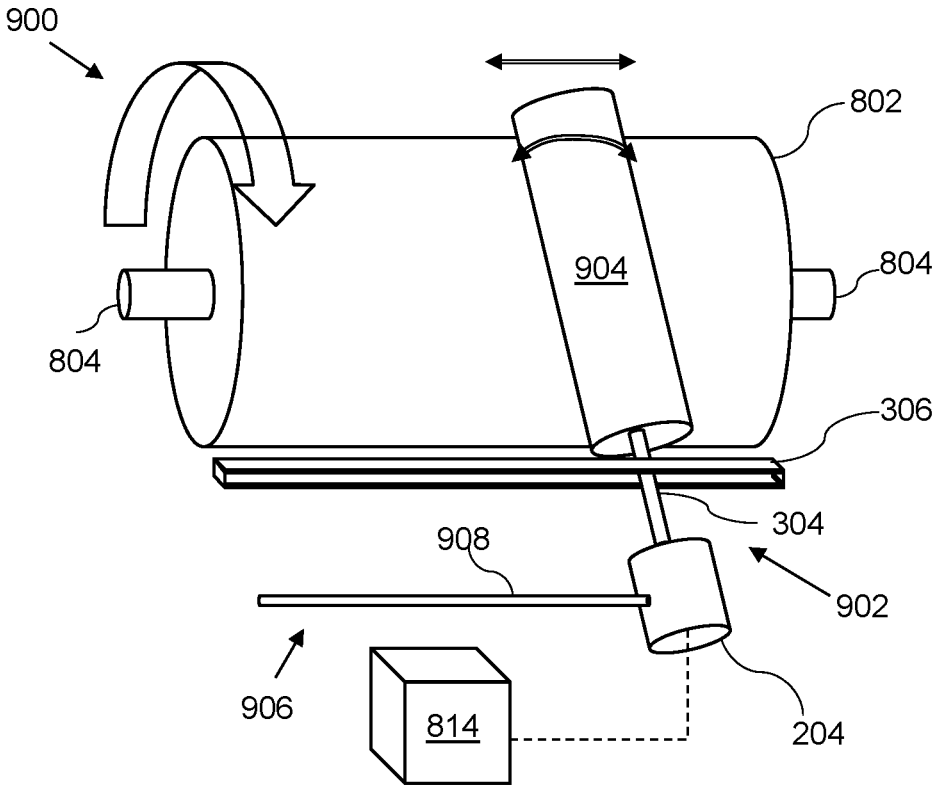
FIG. 9 shows another example of a print apparatus.

FIG. 9 is another example of a print apparatus 900, in this example incorporating cleaning apparatus similar to that shown in FIG. 3. Features in common with the apparatus of FIGS. 3 and 8 are labelled with like numbers.

In this example, the cleaning element 902 is a cleaning cylinder having an endless cleaning surface 904 mounted on a cylinder axle 304 and the drum axle 804 and the cylinder axle 304 are nonparallel. The print apparatus 900 comprises a cleaning element translation mechanism 906 in the form of a rail 306 having a cut-out slot through which the cylinder axle 304 is mounted, wherein a pushrod 908 provides a drive mechanism of the cleaning element translation mechanism 906, which, in operation of the print apparatus 900, acts on the end of the cylinder axle 304 so as to translate the position of the cylinder axle along the length of the drum axle 804.

In this example, the controller 814 is, in use of the apparatus 900, to vary at least one of rotational velocity of the rotating cleaning element 902 and a translational velocity of the cleaning element 902. In some examples, these may be varied during a cleaning operation so as to change the orientation of a wiping line formed between the cleaning element 902 and the surface of drum 802.

Aspects of some examples in the present disclosure can be provided as methods, systems or machine readable instructions, such as any combination of software, hardware, firmware or the like embodied by the controller 314. Such machine readable instructions may be included on a computer readable storage medium (including but is not limited to disc storage, CD-ROM, optical storage, etc.) having computer readable program codes therein or thereon.

The present disclosure is described with reference to flow charts and block diagrams of the method, devices and systems according to examples of the present disclosure. Although the flow diagrams described above show a specific order of execution, the order of execution may differ from that which is depicted. Blocks described in relation to one flow chart may be combined with those of another flow chart. It shall be understood that at least one flow in the flow charts, as well as combinations of the flows in the flow charts can be realized by machine readable instructions.

The machine readable instructions may, for example, be executed by a general purpose computer, a special purpose computer, an embedded processor or processors of other programmable data processing devices to realize the functions described in the description and diagrams, and which may for example comprise at least part of a controller 314, 814. In particular, a processor or processing apparatus may execute the machine readable instructions. Thus functional modules of the apparatus and devices may be implemented by a processor executing machine readable instructions stored in a memory, or a processor operating in accordance with instructions embedded in logic circuitry. The term 'processor' is to be interpreted broadly to include a CPU, processing unit, ASIC, logic unit, or programmable gate array etc. The methods and functional modules may all be performed by a single processor or divided amongst several processors.

Such machine readable instructions may also be stored in a computer readable storage that can guide the computer or other programmable data processing devices to operate in a specific mode.

Further, the teachings herein may be implemented in the form of a computer software product, the computer software product being stored in a storage medium and comprising a plurality of instructions for making a computer device implement the methods recited in the examples of the present disclosure.

While the method, apparatus and related aspects have been described with reference to certain examples, various modifications, changes, omissions, and substitutions can be made without departing from the spirit of the present disclosure. It is intended, therefore, that the method, apparatus and related aspects be limited by the scope of the following claims and their equivalents. It should be noted that the above-mentioned examples illustrate rather than limit what is described herein, and that those skilled in the art will be able to design many alternative implementations without departing from the scope of the appended claims. Features described in relation to one example may be combined with features of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims and/or other dependent claim(s).

The invention claimed is:

1. Print apparatus component cleaning apparatus comprising:

a cleaning element having a cleaning surface;

a motor to drive the cleaning surface;

a mounting element to mount the cleaning element such that the cleaning surface is drivable with a component of motion which is orthogonal to the motion of a surface of a print apparatus component to be cleaned, wherein the cleaning surface comprises a cleaning cylinder mounted on a cylinder axle; and a controller to vary a relative velocity of the cleaning surface and the surface of the print apparatus component.

2. Print apparatus component cleaning apparatus according to claim 1 wherein the controller is to control at least one of a speed and a direction of the motor.

3. Print apparatus component cleaning apparatus according to claim 2 in which the cleaning element comprises a sponge cylinder and the controller is to control a velocity of revolution of the sponge cylinder.

4. Print apparatus component cleaning apparatus according to claim 1 in which the mounting element comprises a mounting rail and a drive mechanism to drive the cleaning element along a length of the print apparatus component to be cleaned.

5. Print apparatus component cleaning apparatus according to claim 1 further comprising a biasing element to control a pressure between the cleaning element and the print apparatus component to be cleaned.

6. Print apparatus component cleaning apparatus according to claim 1 in which the cleaning element comprises a rotating surface.

7. Print apparatus comprising:

a drum mounted on a drum axle;

a cleaning element having a cleaning surface in contact with a surface of the drum;

a motor to drive the cleaning surface to have a component of motion parallel to the drum axle;

a cleaning element translation mechanism to move the cleaning element along a length of the drum, wherein the cleaning element comprises a cleaning cylinder mounted on a cylinder axel, wherein the drum axle and the cylinder axle are nonparallel; and a controller to control a speed of the motor.

8. Print apparatus according to claim 7 in which the controller is to vary at least one of a rotational velocity and a translational velocity of the cleaning element.

* * * * *